United States Patent [19]

Suter et al.

[11] 4,146,140

[45] Mar. 27, 1979

[54] SUPPORT SYSTEM

[76] Inventors: Adolf Suter, Enzberg; Heiner Stettler, Im Hof, both of 5264 Gipf-Oberfrick, Switzerland

[21] Appl. No.: 760,608

[22] Filed: Jan. 19, 1977

[51] Int. Cl.[2] ..... A47F 5/00

[52] U.S. Cl. ..... 211/190; 108/109; 211/208; 248/243

[58] Field of Search ..... 211/187, 190, 193, 207, 211/208; 248/243; 108/107, 109

[56] References Cited

U.S. PATENT DOCUMENTS

| | | | |
|---|---|---|---|
| 2,236,044 | 3/1941 | Vanderveld et al. | 248/243 |
| 2,263,282 | 11/1941 | Welch et al. | 248/243 |
| 3,080,980 | 3/1963 | Gibbons | 248/243 X |
| 3,182,812 | 5/1965 | Fenwick | 211/187 X |
| 3,394,507 | 7/1968 | Doke | 108/107 X |
| 3,562,970 | 2/1971 | Schwartz | 248/243 X |
| 3,648,419 | 3/1972 | Marks | 211/187 X |
| 3,730,477 | 5/1973 | Wavrunek | 248/243 |
| 3,759,191 | 9/1973 | Freeman | 248/243 X |
| 3,828,937 | 8/1974 | Nash | 211/187 X |
| 3,866,758 | 2/1975 | Strassle | 298/243 X |

FOREIGN PATENT DOCUMENTS

| | | | |
|---|---|---|---|
| 2304698 | 8/1974 | Fed. Rep. of Germany. | |
| 2358828 | 5/1975 | Fed. Rep. of Germany | 248/243 |
| 91912 | 7/1968 | France | 248/243 |
| 641479 | 6/1962 | Italy | 108/107 |

*Primary Examiner*—Roy D. Frazier
*Assistant Examiner*—Robert W. Gibson, Jr.
*Attorney, Agent, or Firm*—Pollock, Vande Sande & Priddy

[57] ABSTRACT

A beam construction for supporting shelves, cabinets and like units between upright wooden beams. The connection comprises a single support element at each end of a unit to be supported having two vertically superposed hooks at one end for hooking into a single rail in the beam, and a single upward projection at the other end for hooking into an aperture in the bottom of the unit to be supported. A vertical slot in said unit hides the corresponding vertical portion of the support element so that the support structure is invisible during normal inspection. Despite the single point support feature, the units are secure against tipping and against damage during assembly and disassembly.

11 Claims, 8 Drawing Figures

FIG. 4
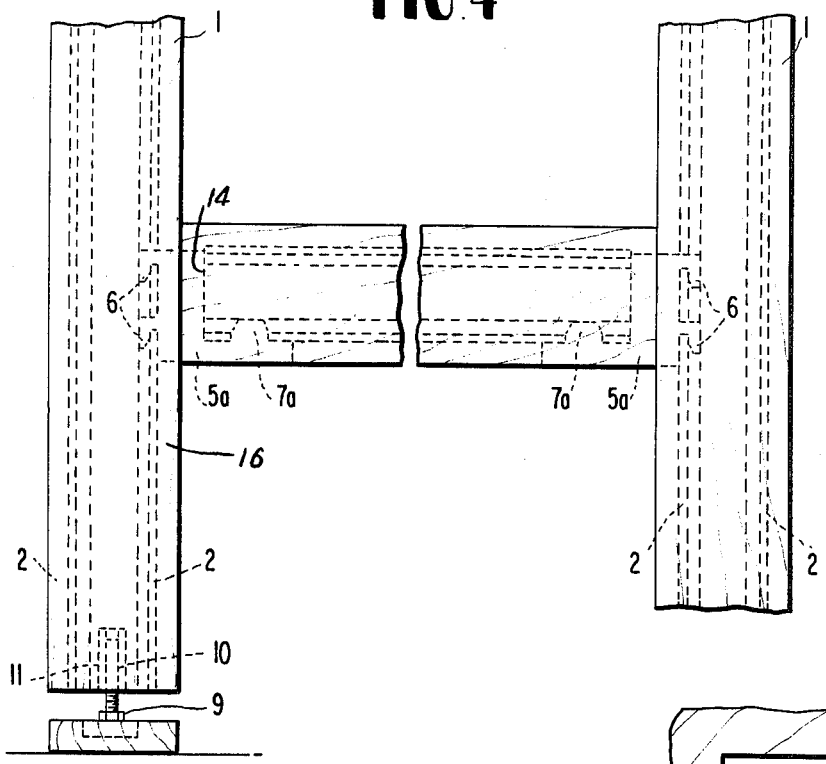
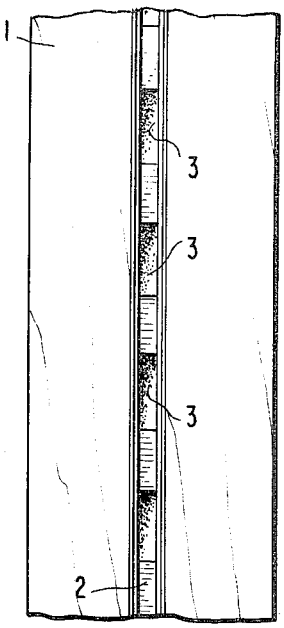
FIG. 5
FIG. 6
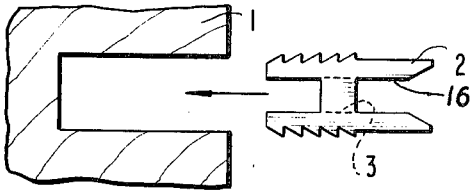
FIG. 7
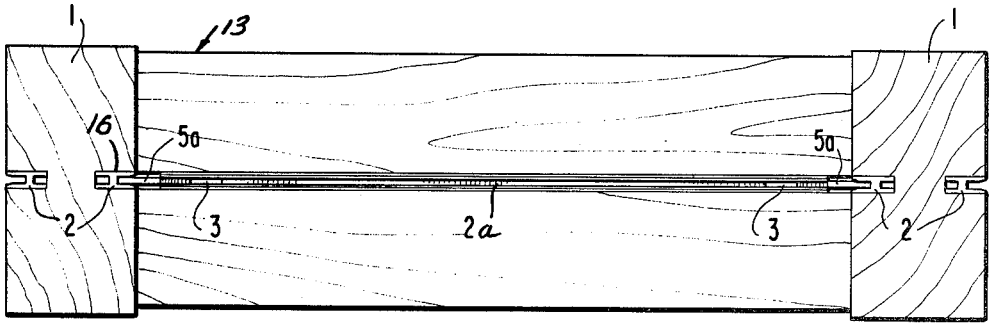
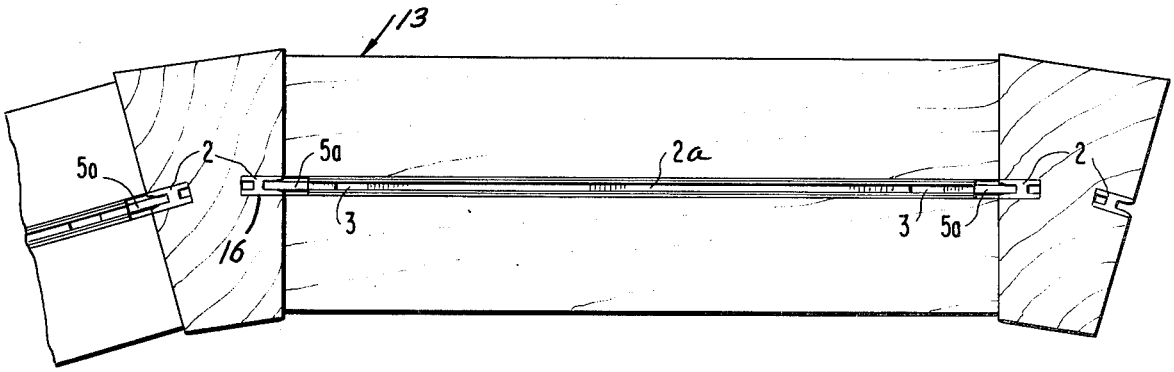
FIG. 8

SUPPORT SYSTEM

The present invention relates to a beam construction for dressing up or camouflaging interior walls or for subdividing rooms, and comprises vertical and horizontal beams formed by units having rectangular cross sections.

Sets of units for the construction of wall systems having vertical and horizontal supports which can be combined with cabinets and the like are well known in the art. Such wall systems, normally arranged along interior walls or as room dividers, are desirable for their decorative, wall camouflaging aspect on the one hand, and for interrupting the line of vision on the other hand. However, an undesirable characteristic of such prior art units is that they occupy a considerable amount of needed space, and that they may quickly show wear if they are repeatedly dis- and reassembled. A particular prior art system having the latter disadvantage is disclosed in German Published Application (DOS) No. 2,304,698, which discloses vertical beams sub-divided into partial beams connected by slotted spacer rails which bridge vertical recesses in the respective partial beams, and which simultaneously serve to receive the hooked portions of support members for horizontal units to be supported between the vertical beams. The horizontal units also are subdivided into two portions connected by spacers.

The object of the present invention is an arrangement which, while effective for camouflaging walls or subdividing rooms, is also decorative and requires much less space than prior art wall systems. The arrangement is also extremely effective for linking various articles of furniture.

According to the invention, sturdy vertical beams having slotted sides are provided with slotted rails into which shelves, cabinets and the like can be hung by means of carrier hooks. The assembly is so formed that the various components, which are normally made of wood, are not damaged to any substantial extent even by frequent dis- and reassembly. Moreover, the slotted rails are, to all intents and purposes, hidden from view.

In order that the invention may be more clearly understood, reference will now be made to the accompanying drawings, in which several embodiments of the invention are shown for purposes of illustration, and in which:

FIG. 4 is a front view of the arrangement according to the invention, showing a furniture unit hung between two vertical beams.

FIG. 5 is a side view of a vertical beam according to the invention, showing the construction of a slotted rail.

FIG. 6 is an exploded plan view of the slotted rail.

FIG. 7 is a plan view of the arrangement shown in FIG. 4.

FIG. 8 shows a modification of FIG. 6, for use in curved room dividers.

A wall system according to the invention comprises a plurality of vertical beams 1 which may be arranged as desired either along existing interior walls, or as a subdividing wall partitioning a room. As will be explained, the system is sufficiently flexible to permit either an arrangement along a single longitudinal axis, or a curved arrangement.

One or both sides of beams 1 are provided with a recessed vertical groove 16 in which are disposed rails 2 extending along a substantial portion of the length of the beams and having narrow slots 3 at predetermined intervals therein. It will be noted that, in use, the slotted rails 2 are not visible, first, because they are arranged along the sides rather than the front of beams 1, and secondly, because groove 16 which provides access to the rails is exceedingly narrow, as narrow as 3 mm in width.

Figure 1:
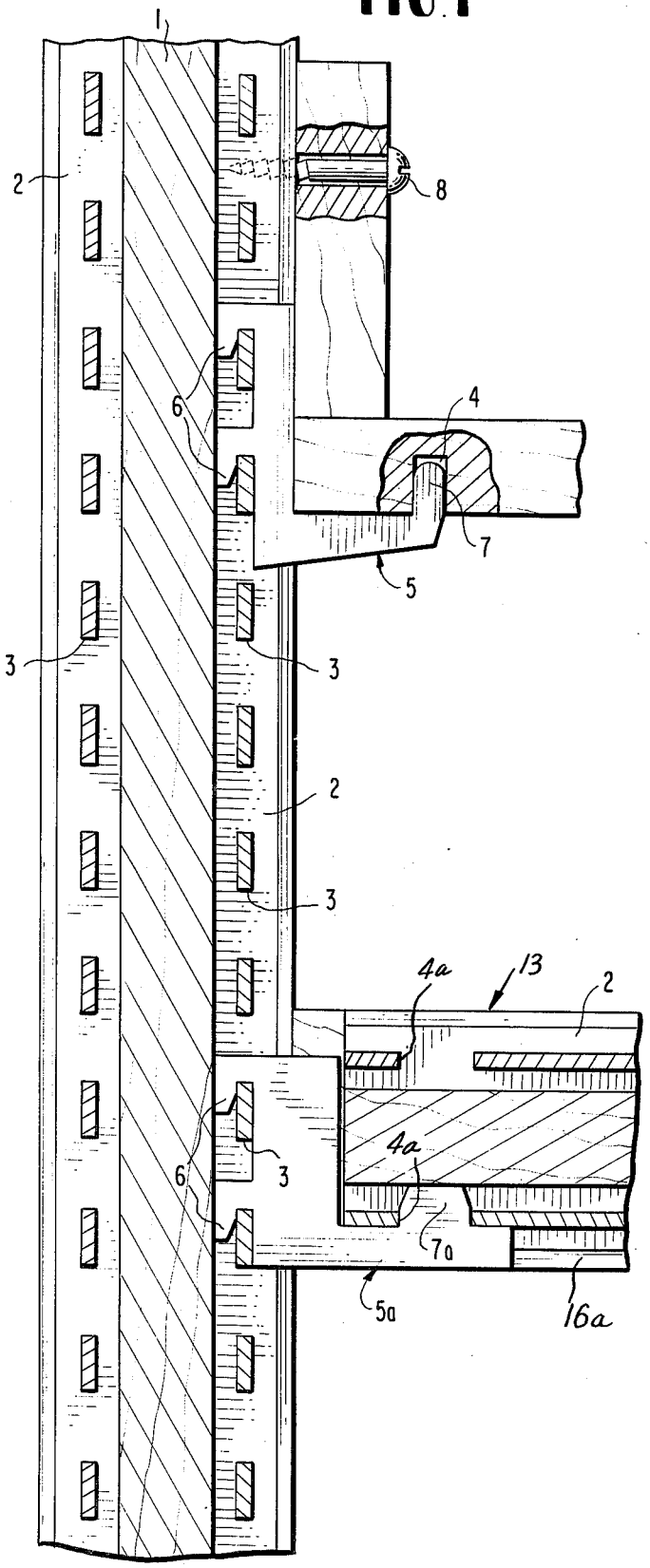
FIG. 1 is a vertical section of a vertical beam having slotted rails, showing two arrangements for hanging horizontal units therein.
Figure 2:
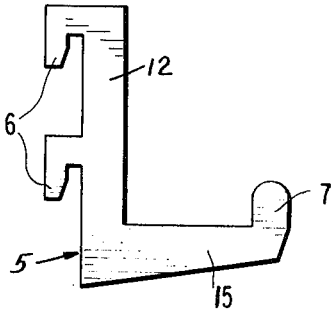
FIG. 2 is a front view of one type of carrier hook used in the system according to the invention.
Figure 3:
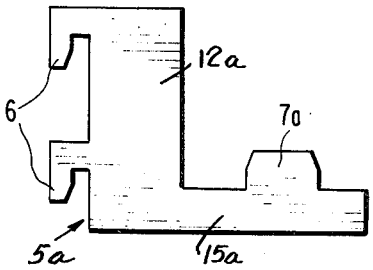
FIG. 3 is a front view of a second type of carrier hook used in the system according to the invention.

Shelves or furniture units to be supported between adjacent vertical beams 1 are provided with vertical grooves 14 in their ends facing beams 1, permitting the insertion of carriers which are also adapted to engage slots 3 of vertical rails 2. The bottom faces of units 13 are provided with horizontal grooves **16*a* similar to vertical grooves 16 in beams 1, and have rails 2*a* disposed therein similar to the rails disposed in said vertical grooves. However, the horizontal rails in units 13 have only a single slot or indentation 4 or 4*a*** adjacent each and thereof, as will be described hereinafter. These indentations, being located in the bottom face of the units, are invisible during normal inspection. As shown in FIG. 1, such indentations may also be provided in the top faces of said units if versatility is desired.

While two forms (5 and **5*a*) of carrier are shown, it will be understood that other configurations may be used, depending on the shape and weight of the unit to be supported. It will be noted, however, that each carrier is provided with at least two hooks 6 for insertion in at least two adjacent slots 3**, so that reasonable stability and support is assured.

The portion of each carrier opposite from the aforementioned hooks 6 has an upwardly extending portion 7 or **7*a* which fits into an indentation 4 or 4*a* in the bottom face of the unit to be supported. In addition, the vertical portion 12 or 12*a* connecting hooks 6 is adapted to engage both a groove 14 extending vertically in each of the sides of said unit to be supported facing said vertical beams, from the bottom face of said unit and terminating below the the top face thereof; and groove 16 extending vertically in each of said mutually facing sides of said vertical beam members. As can be seen particularly in FIG. 4, support for the unit is preferably provided at at least six points, i.e., by two hooks 6; by the engagement of upwardly extending portion 7 or 7*a* in indentation 4 or 4*a*; by the engagement of portions 12 or 12*a* of the carriers with both grooves 16 of vertical beams 1 and with vertical grooves 14 in units 19; and by the engagement of horizontal portion 15 or 15*a* of the carriers with horizontal groove 16*a* in the bottom of units 13**. This total end-to-end engagement of the carriers assures thereby a solid fit, stability against tipping and an appearance of permanence without the need for further securing means.

For installations requiring a curved arrangement, e.g., as a room divider, either the vertical beam 1 or the element to be supported, or both, may be given a non-rectangular cross-section, as shown by way of example in FIG. 8. It will be appreciated that the configuration of the respective units can be built to the customer's specifications, permitting an almost infinite variety of room arrangements.

For use in supporting particularly heavy units, it may be desirable to provide additional fastening means, as shown by way of example in FIG. 1, where the additional fastening means is in the form of screw 8 attaching an upwardly extending sidewall of a horizontal unit to beam 1 between adjacent slots 3. The screw may be countersunk for the sake of appearance, and other desired fastening means may be substituted.

Adaptation of the vertical beams to the height of the room and possible unevenness of the floor and/or ceiling is facilitated by means of an adjusting screw 9 which engages interior threading 10 in a slot 11 in the bottom face (shown in FIG. 1) and/or top face of beam 1. Unscrewing of screw 9 tightens the fit of beam 1 between floor and ceiling, and permits small leveling adjustments of the units being supported.

What we claim is:

1. Support structure for units of furniture and the like, comprising:

(a) at least two unitary spaced vertical nonmetallic beam members having mutually facing sides each having a vertical recessed portion therein;

(b) a vertically extending rail member fitted entirely within each of said recessed portions;

(c) at least two vertically superposed slots in each said rail member;

(d) a unitary member to be supported horizontally between said beam members, said member to be supported having a vertically extending indentation in each end thereof, and a horizontal recessed portion in a bottom face thereof with a horizontally extending rail member fitted entirely within said horizontal recessed portion, said horizontally extending rail member having at least one horizontal slot adjacent each end thereof;

(e) a support element having first portions comprising two hook means extending from the member to be supported toward said slots in said vertically extending rail and being adapted to engage said slots;

(f) a second portion of said support element comprising an upwardly extending protuberance near the end of the support element remote from said first portions, and being adapted to couple with said horizontal slot near one end of the horizontally extending rail member;

(g) a third portion of said support element comprising a substantially vertical portion joining said first portions and said second portion, and being adapted to engage (i) said indentation in the end of the member to be supported; and (ii) said vertical recessed portion in each of said mutually facing sides of said vertical beam members;

(h) a fourth portion of said support element comprising a horizontally extending portion joining said second and third portions, and being adapted to be embedded in said horizontal recessed portion in the bottom surface of said member to be supported;

(i) whereby a said support element immovably connects the respective ends of said member to be supported with mutually facing sides of said beam members.

2. Support structure according to claim 1, wherein each said support element comprises a plate having a thickness of less than 5 mm.

3. Support structure according to claim 2, wherein said plate has a thickness of 3 mm.

4. Support structure according to claim 2, wherein said plate is made of metal.

5. Support structure according to claim 2, wherein said plate is made of plastic.

6. Support structure according to claim 2, wherein said plate has a generally L-shaped configuration, said first portions extending laterally from the vertical leg thereof, and said third portion generally comprising the said vertical leg thereof.

7. Support structure according to claim 1, wherein said vertical beam members have substantially rectangular horizontal cross sections.

8. Support structure according to claim 1, wherein said member to be supported has a substantially rectangular horizontal cross section.

9. Support structure according to claim 1, wherein said vertical beam members have matching non-rectangular cross sections.

10. Support structure according to claim 1, wherein said members to be supported has a vertically extending portion, and including fastening means for attaching said vertically extending portion to a said vertical beam member.

11. Support structure according to claim 1, including adjusting means disposed in the bottom face of a said vertical beam member for adjusting the fit of said beam member between floor and ceiling.

* * * * *